United States Patent [19]

Grimes et al.

[11] Patent Number: 4,903,396

[45] Date of Patent: Feb. 27, 1990

[54] METHOD OF CONTAINING AN AMORPHOUS CORE JOINT

[75] Inventors: Frank H. Grimes, Athens; Terrence E. Chenoweth, Watkinsville, both of Ga.

[73] Assignee: Westinghouse Electric Corp., Pittsburgh, Pa.

[21] Appl. No.: 323,460

[22] Filed: Mar. 14, 1989

[51] Int. Cl.[4] ..... H01F 41/12

[52] U.S. Cl. ..... 29/606; 29/605; 336/217; 336/234

[58] Field of Search ..... 29/605, 606, 609, 602.1; 336/212, 213, 216, 217, 234

[56] References Cited

U.S. PATENT DOCUMENTS

| | | |
|---|---|---|
| 4,592,133 | 6/1986 | Grimes et al. . |
| 4,615,106 | 10/1986 | Grimes et al. . |
| 4,709,471 | 12/1987 | Valencic et al. . |
| 4,723,349 | 2/1988 | Grimes . |
| 4,761,630 | 8/1988 | Grimes et al. . |

*Primary Examiner*—Carl E. Hall

*Attorney, Agent, or Firm*—Joyce L. Morrison

[57] ABSTRACT

A method and apparatus for manufacturing a transformer having an amorphous metal core. The face of the joint portion of the amorphous metal core is covered with an oil compatible porous pads. Pressure plates are disposed over the pads. A frame positioned generally around the plates secures the pads and plates to the amorphous metal core. Banding straps may be threaded about the core assembly to further secure the core assembly.

10 Claims, 2 Drawing Sheets

METHOD OF CONTAINING AN AMORPHOUS CORE JOINT

BACKGROUND OF THE INVENTION

1. Field of the Invention

The invention relates in general to electrical transformers, and more specifically to new and improved methods of constructing transformers which include a cut, jointed amorphous metal core.

2. Description of the Prior Art

The core losses in the electrical transformers used by electric utility companies represents a significant loss of generated energy, even though transformers are highly efficient. With the increasing value of energy, ways of reducing these losses are constantly being sought. The use of amorphous metal in the magnetic cores of distribution and power transformers appears to be attractive, because, at equivalent inductions, the core losses of electrical grade amorphous metals are only 25% to 35% of the losses of conventional grain-oriented electrical steels.

Amorphous metals, however, in addition to their higher initial cost than conventional electrical steels, also pose many manufacturing problems not associated with conventional electrical steels. For example, amorphous metal is very thin, being only about 1 to 1½ mils thick, and it is very brittle, especially after anneal. Amorphous metal is also very stress sensitive. Any pressure on the magnetic core, or change in its configuration after annealing, will increase its losses. Another characteristic of amorphous metal cores which creates manufacturing problems is the extreme flexibility of the core after it is wound. For example, a core wound of amorphous metal is not self-supporting. When the mandrel upon which the core is wound is removed, the core will collapse from its own weight, if the winding is not maintained in a vertical orientation.

The problems associated with amorphous metal cores have made the manufacture of the cores very labor intensive and very expensive. Various solutions to these problems have been proposed. See, for example, U.S. Pat. Nos. 4,592,133; 4,615,106; 4,723,349; 4,761,630; 4,766,407 and 4,709,471.

In spite of these disclosures, there remains a need for a method of manufacturing an amorphous metal core with reduced manufacturing cost and production line complexity.

SUMMARY OF THE INVENTION

We have discovered that transformers having amorphous metal cores can be produced in such a way that minimizes fretting failure and is less labor intensive.

In this invention, an oil compatible porous pad is introduced between pressure plates and the face of the core joint. The pads and plates are secured in place by a frame. This apparatus and method effectively traps particulate matter while allowing for the flow of fluids to the core.

It is an object of the present invention to provide an improved amorphous core transformer.

It is another object of the invention to provide an economical method of manufacturing amorphous metal cores.

It is a further object to provide an amorphous metal core with reduced fretting failure.

BRIEF DESCRIPTION OF THE DRAWINGS

The invention will become more apparent by reading the following detailed description in conjunction with the drawings, which are shown by way of example only, wherein.

DETAILED DESCRIPTION OF THE PREFERRED EMBODIMENTS

A jointed amorphous metal core for use in transformers includes oil compatible porous pads which are placed over the face of the joint of the core. Pressure plates are then positioned in generally intimate contact with the oil compatible porous pads. A frame is placed about the pressure plates to secure both the oil compatible pads and the pressure plates in generally intimate contact with the core face. This configuration provides an economical jointed amorphous metal core by reducing labor costs and product line complexity. Further, fretting between the core joint containment of the prior art and the edges of the core has been a problem as the edges of the core are extremely sharp and rough. The present invention eliminates fretting failure.

Figure 1:
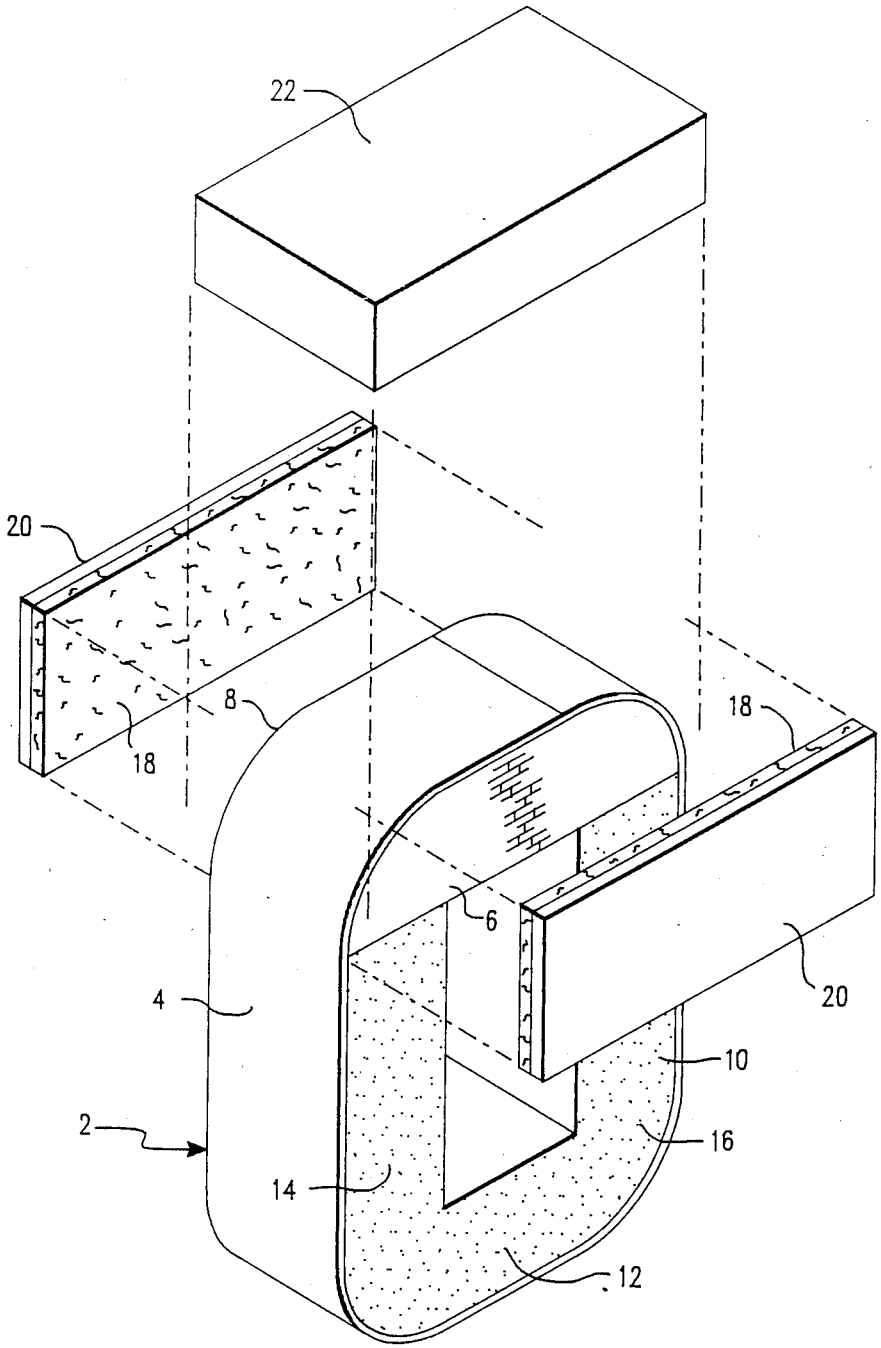
FIG. 1 is an exploded view showing a presently preferred embodiment of an amorphous metal core in an early stage of preparation according to a method of this invention.
Figure 2:
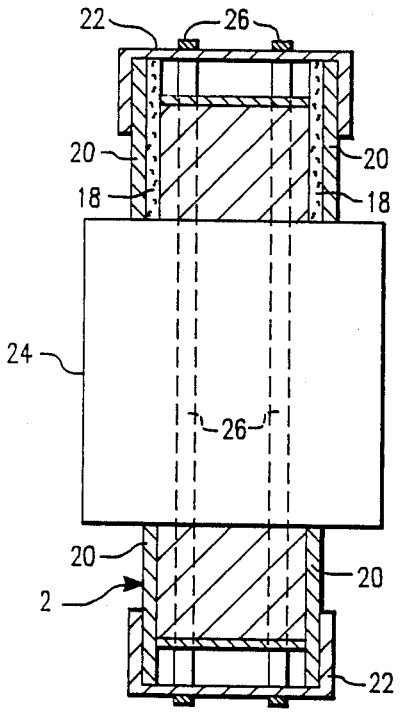
FIG. 2 shows a presently preferred embodiment of an end view of an amorphous metal core of the present invention.

The method, as shown in FIGS. 1 and 2, is performed after the core has been removed from, the core joint has been closed and enclosed by an outer wrap of an electrical steel jacket, such as hypersil.

FIG. 1 shows an exploded view of an amorphous metal core 2. A single core 2 is shown for purposes of illustration. However, multiple cores may be used in this invention. The core 2 is formed over a carbon steel mandrel (not shown) and may be placed in an electrical steel jacket 4. The core has two faces 6, 8 and three legs 10, 12, 14.

Any number of cores can be used in the transformer, and the invention is not intended to be limited to the two-legged core-form transformer shown in the drawings. For example, the invention is also applicable to shell-form transformers, where a single coil (having two or more windings) encircles the butted legs of two cores. The amorphous metal core need not be rectangular, but may have any other suitable shape, such as cruciform (rectangular, but with a circular cross-section) or torus (circular or oval with a rectangular or circular cross section).

The amorphous metal core may consist of a single corelette, or of multiple corelettes where a transformer of greater width is desirable than the available width of amorphous metal. Amorphous metal is a commercially available material sold by Allied Signal Corporation under the trade designation "METGLAS" in a nominal thickness of about 1 mil and a width of about 1 inch to about 8 inches. It is generally made of iron, boron, and silicon, and typically contains about 80% (by weight) iron, 14% boron, and 4% silicon, and may also contain carbon, nickel, and other elements. It is prepared by rapidly quenching a thin sheet of metal. (See U.S. Pat. No. 3,845,805, herein incorporated by reference, for additional information). This invention is applicable to any type of transformer containing an amorphous metal core where the core is wound and cut, but the transformer is preferably a distribution oil-cooled transformer as the teachings of this invention are most applicable to this type of transformer.

Resinous material 16 may optionally be applied to a face 6 or faces 6, 8 of the core legs 10, 12, 14 of the core 2. Resin coated material 16 is applied to the faces of a transformer core to give the transformer core strength, for ease of manufacture and to eliminate the escape of amorphous metal pieces out of the core. In a presently preferred embodiment, the resinous material is made up of multiple components. Specifically a substrate having a resinous material coated thereon may be applied to the faces 6, 8 of the core legs 10, 12, 14.

Any resinous adhesive may be used as long as the resinous material is compatible with the resin coated substrate and transformer oil. It is preferred that thermally curable resins (such as B553, a trade product of Westinghouse Electric Corporation, Manor, Pa.) be used. In a presently preferred embodiment, the adhesive may be applied to a substrate prior to application to the core. The presently preferred substrate is Kraft paper impregnated with a thermally curable resin.

An oil compatible porous pad 18 is selected for its compatibility with the transformer environment. Specifically, the preferred pad 18 should be compatible with transformer oil and be porous in order to allow for the ingress and egress of transformer fluids while inhibiting the flow of amorphous metal shards. In addition, the oil compatible porous pads are preferably flexible, compressible and thermally stable. Felt or foam pads are preferred as the oil compatible porous pads 18. Foam pads, such as polyester, for example, should be open cell foam and be elastomeric. Suitable examples of felt pads are cleaned wool, cotton felt and the like.

Referring to FIGS. 1 and 2, a pressure plate 20 is to be placed in generally intimate contact with the pads 18. Pressure plates 20 are generally used to secure the coil without applying stress to the core 2 and to secure the core and coil assembly to a housing such as a tank or other container (not shown). The pressure pads 20 may be any non-metallic insulating material such as masonite, cardboard, timber, laminates, such as Micarta, product of Westinghouse Electric Corporation, and the like.

The oil compatible porous pads 18, and the pressure plates 20 extend from above the core down the face of the core to the coil 24. The oil compatible porous pads 18, pressure plates 20, and frame 22 secured to the core 2 form the core assembly. Preferably the core assembly is disposed on the top portion and the bottom portion of the core 2, as shown in FIG. 2.

A frame 22 is to be placed over the pressure plates 20 to secure the oil compatible porous pads 18 and pressure plates 20 in generally intimate contact with the faces 68 of the core joint. The frame 22 may be made of any securing type material. Carbon steel is particularly preferred. The frame 22 extends down the core face generally along the surface of the pads 18 or plates 20. The frame 22 overlaps the core face 6 to maintain the integrity of the pressure plate 20 position. The frame 22 is designed to preferably interference fit the oil compatible porous pads 18 and pressure plates 20 to the core. Specifically, it is preferred that the frame size be such that the oil compatible porous pads 18 are somewhat compressed in position.

Banding straps 26 are placed about the top of the frame, threaded or fed between the core 2 and oil 24 around the bottom frame 22, pulled tightly and clamped into position. The banding straps 26 secure the entire core assembly into position.

Referring to FIG. 2, which shows an end view of finished core product, the core 2 has a coil 24 in position. The oil compatible porous pads 18 are in generally intimate contact with the core faces 6, 8 of the closed joint area. The pressure plates 20 are in generally intimate contact with the oil compatible porous pads 18. Frame 22 has been positioned over the plates 20. The frame 22 extends over the top of the core 2 and positions or secures the pressure plates 22 in a generally vertical position, thus securing the pads 18 in generally intimate contact with the core 2.

The presently preferred embodiment allows for a gap between the top of the core 2 and the frame 24. This gap allows for the securement of components, such as circuit breakers, to the frame 22 without damage to the core 2.

Wool felt and polyester foam were used for the test, the pads being 3/16" thick and the units were both transit tested for 4 hours. No degradation of losses resulted from these tests, but some small fragments of Metglas were found enmeshed in the pads when the units were torn down.

Neither the felt pads nor the foam pads showed any degradation or abrasive wear on the edges where rubbing contact occurs against the pressure plates demonstrating the effectiveness of the seal of the oil compatible porous pads 18 pressure pads 20 and frame 22 as a particulate filter under severe conditions. This test also demonstrated the need for core containment.

The estimated time to install the materials of the apparatus is less than one minute.

Whereas particular embodiments of the invention have been described above for purposes of illustration, it will be appreciated by those skilled in the art that numerous variations of the details may be made without departing from the invention as described in the appended claims.

We claim:

1. A method of making a transformer having an annealed wound amorphous core having a joint and a top portion and a bottom portion and two core faces comprising:

(A) placing oil compatible porous pads on each core face of the amorphous metal core joint;

(B) placing pressure plates in generally intimate contact with said oil compatible porous pads; and (C) placing a framing means generally about said pressure plates to secure said pads and plates to said core to form a core assembly.

2. The method of claim 1 including providing foam or felt as said oil compatible porous pads.

3. A method according to claim 1 including placing a coil over each leg of said amorphous metal core prior to step (A).

4. The method of claim 3 including wrapping banding straps around said core assembly but not around said coils.

5. A method according to claim 1 including annealing of said core prior to step (A).

6. A method according to claim 1 including applying a resin coating and structural support means to said core legs prior to step (A).

7. A method according to claim 3 including interference fitting said framing means about said oil compatible porous pads and said pressure plates.

8. A method according to claim 1 including extending said oil compatible porous pads and said pressure plates along said core face to said coil.

9. A method according to claim 1 including placing pressure plates in generally intimate contact with said bottom portion of said core and placing a framing means generally about said pressure plates to secure said pressure plates to said bottom portion of said core after step (C).

10. In a method of making a transformer having a wound amorphous metal core having a joint, and a core face that makes said transformer self-supporting, characterized by substantially covering the core face of the core joint with an oil compatible porous pad and pressure plates and securing said oil compatible porous pads and pressure plates to said core face with frame means.

* * * * *